US006327993B1

(12) United States Patent
Richens, Jr.

(10) Patent No.: US 6,327,993 B1
(45) Date of Patent: Dec. 11, 2001

(54) OVERHEAD STORAGE SYSTEM FOR A BIMINI FRAME

(76) Inventor: David A. Richens, Jr., 1530 N. Hollydale Dr., Fullerton, CA (US) 92831

( * ) Notice: Subject to any disclaimer, the term of this patent is extended or adjusted under 35 U.S.C. 154(b) by 0 days.

(21) Appl. No.: 09/874,575

(22) Filed: Jun. 5, 2001

(51) Int. Cl.[7] ..... B60R 9/12

(52) U.S. Cl. ..... 114/361; 224/406; 135/88.01; 114/343

(58) Field of Search ..... 135/96, 88.01; 224/406; 114/343, 361

(56) References Cited

U.S. PATENT DOCUMENTS

| | | | |
|---|---|---|---|
| D. 383,112 | 9/1997 | Patterson . | |
| 1,511,864 | 10/1924 | Altmyer . | |
| 4,466,659 | 8/1984 | Carpenter . | |
| 4,756,455 | 7/1988 | Kitner . | |
| 4,995,537 | 2/1991 | Thedieck . | |
| 5,931,114 | 8/1999 | Bartholomew . | |
| 6,257,261 * | 7/2001 | Johnson | 135/96 |

* cited by examiner

*Primary Examiner*—Ed Swinehart
(74) *Attorney, Agent, or Firm*—Mark H. Plager

(57) ABSTRACT

An overhead storage system for a boat bimini top comprising an elongated unitized backing material. The backing material has a front end, a rear end, a left and right side, a top surface, and bottom surface. Attached to the bottom surface of the backing material is a series of storage pockets. The storage pockets are of varying sizes and are generally rectangular in shape and have a hinged lid. Along the bottom left and right side of the backing material is an edge channel housing a telescoping pole. The telescoping poles provide support and structure to the backing material and storage pockets. At the bow end of each telescoping pole is a V-shaped bend, which generally conforms to the contour of a bimini shade cover. Mounted perpendicular to the telescoping poles and below the backing material, are several spreader bars. On the top side of the backing material are a series of support battens and batten sleeves which keep the backing material from sagging. The backing material, storage pockets, and telescoping pole assembly is removably attached to the front end of a bimini shade cover frame by a bow hook and to the rear of a bimini frame by a stern hook assembly. The invention provides convenient, removable, overhead storage without any modifications or alteration to the boat bimini shade cover.

19 Claims, 7 Drawing Sheets

OVERHEAD STORAGE SYSTEM FOR A BIMINI FRAME

CROSS-REFERENCES TO RELATED APPLICATIONS

None.

BACKGROUND OF THE INVENTION

1. Field of the Invention

This invention relates to an overhead storage system, specifically to an overhead storage system attachable to a boat bimini top.

2. Description of Prior Art

The National Marine Manufacturers Association estimates that there are over sixteen million recreational boats in use today. These sixteen million boats consist mainly of outboard, stern drive, and inboard powered boats as well as personal watercraft and sailboats. One thing they all have in common is the need for storage within the cockpit and seating area. In particular, a convenient, safe, dry, and easily accessible compartment to store the personal items of the boat owner and passengers. As a result, boat builders have long sought to provide convenient, useful, and dry storage in the boats they manufacture. Commonly, a glove box compartment, seat back pouch, under-bow storage, or under-seat storage devices are built into new boats. These devices have their limitations. For instance, within a glove compartment personal items tend to become piled one atop another providing little or no organization. The same holds true seat-back storage. Under bow-storage provides abundant space but does not lend itself to organizing small personal items while requiring the boat operator or passenger to crawl on hands and knees to access the space. Under-seat storage further requires the boater to stand and remove the seat cushion to gain access. Furthermore, under-seat storage tends to be damp, and is not conducive to the orderly storage of personal items.

Inventors have devised other storage systems such as U.S. Pat. No. 4,466,374 which discloses a fabric windshield with storage pockets. However, this device only provides storage outside the cockpit, which possesses only two storage pockets and requires that special fittings be installed on the boat. U.S. Pat. No. 1,511,864 issued to Altmyer claims an overhead hat hanger for an automobile which is limited to top-hat storage.

U.S. Pat. No. 4,756,455 issued to Kitner claims a saddle-bag attachable to the engine compartment of a jet-propelled personal water craft. Although useful, the Kitner invention is limited to use only upon a personal watercraft.

U.S. Pat. No. 5,931,114 issued to Bartholomew discloses a rigid boat top which attaches to a boat frame which permits the attachment of various accessories to the bow portion of the boat top such as solar cells, liquid cachment, and storage compartments. The combined weight of the panel members, solar cell, liquid cachment, and/or storage would crush the light weight aluminum structure of most bimini top frames. In addition, installation of any storage compartments is left up to the consumer to design, build and install.

Whether designed by boat manufacturers or by independent inventors, all of the storage devices previously mentioned suffer from a number of disadvantages:

(a) Access to these devices tends to be inconvenient because in most cases the boat operator must stop the craft, move to the location of the storage device, get on hands and knees, or lift a seat cushion before gaining access. This is most true of the seat back pouch, under-seat storage, and bow storage.

(b) Many devices do not provide an effective way to organize the items being stored resulting in the user depositing personal items in a cluttered and unorganized manner one atop the other in the storage space generally resulting in damage to the personal items.

(c) Accumulation of moisture in a storage device causes damage to the items being stored. Storage devices mounted outside the windshield tend to get wet from wind and wave spray. Storage space on or near the floor of the boat accumulate moisture from wet passengers or gear.

(d) Storage devices in present use require tools and special fittings to install tend to be used sporadically due to the time required and the inconvenience suffered.

3. SUMMARY

In accordance with the present invention an overhead storage system for holding objects removably mounted to a bimini frame comprises a multiplicity of storage pockets fixedly attached to a backing material, a pair of longitudinal support means removably housed along the longitudinal edges of the backing fabric, and an attachment means for removably mounting the longitudinal support means to the bow and stern end of the bimini frame.

4. OBJECT AND ADVANTAGES

It is therefore an object of the present invention to provide a new and useful storage system which attaches to water craft bimini tops while providing the greatest capacity of storage with the least amount of encroachment upon useable deck space and headroom. Further objects of this invention are as follows:

(a) to provide an overhead storage system that can be adjusted to fit different sizes of bimini shade cover frames;

(b) to provide a storage system that can be easily and conveniently removed, folded, and stored when not in use;

(c) to provide an overhead storage system which does not significantly interfere with headroom under the bimini shade cover;

(d) to provide an overhead storage system which is easily accessible to the boat operator and passengers;

(e) to provide an overhead storage system which will keep stored items safe and dry;

(f) to provide an overhead storage system whose installation does not require special tools or alterations to the bimini top or boat; and (g) to provide an overhead storage system whose storage pocket configuration can be modified by the user.

Further objects and advantages of the current invention are to provide an overhead storage system which the boater can access while seated, is simple to install, aids boaters in keeping their craft organized, is lightweight, which does not increase wind noise inside the boat cockpit, and will not adversely effect the structural integrity of a bimini top. With the proliferation of hand held electronic devices the current invention provides a safe, readily accessible, and dry area for these devices, e.g., cell phones, global positioning devices, and small digital music players. Still further objects and advantages will become apparent from consideration of the ensuing description and drawings.

BRIEF DESCRIPTION OF THE DRAWINGS

Referring now to the drawings which illustrate the invention as follows.

REFERENCE NUMBERS IN DRAWINGS

Figure 1:
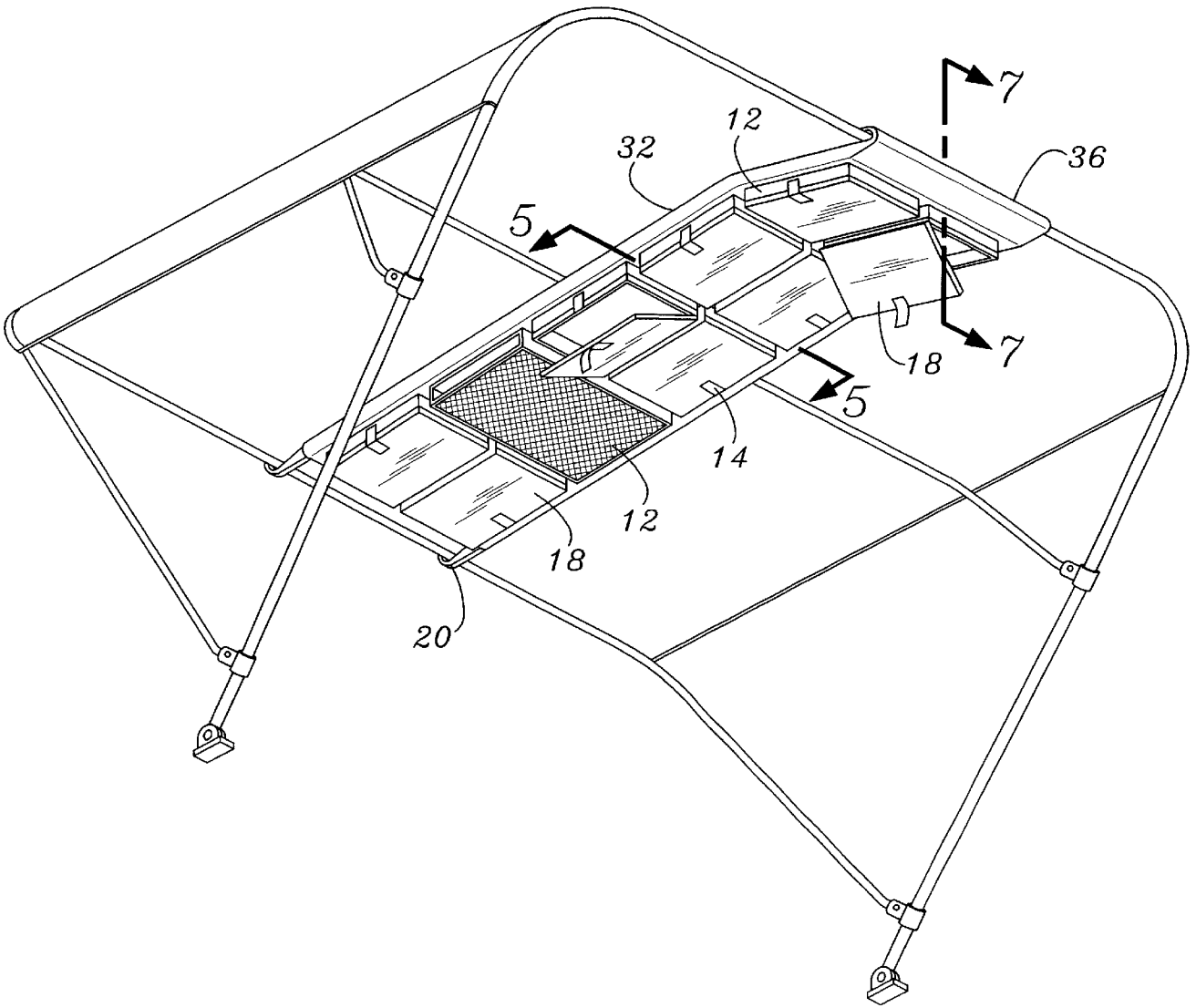
FIG. 1 shows the overhead storage system installed on a bimini top.

10 backing material
12 storage pockets
14 hook and loop fastener
16 telescoping poles
18 storage pocket lid
20 J-shaped stern hook
22 bow hook
24 swivel mounting base
26 threaded rod
28 nylon washer
30 spring steel button
32 edge channel
34 spreader bar
36 airfoil
38 airfoil cuff
40 airfoil sleeve
42 support batten
44 batten sleeve
46 zipper
48 nut and washer
50 V-shaped bend
51 restraint strap

DETAILED DESCRIPTION OF THE PREFERRED EMBODIMENT

A preferred embodiment of the overhead storage system is illustrated in FIG. 1 through FIG. 10. The overhead storage system is comprised of an elongated unitized backing material 10 consisting of a bow end or front, a stern end or rear, a left and right side, a top surface, and bottom surface. Attached to the bottom of the backing material 10 is a series of storage pockets 12 of varying sizes, generally rectangular in shape and having a top side attached to the bottom of the backing material 10, four vertical sides, and a hinged lid 18 securable to one of the vertical sides with either a hook and loop fastener 14 or a zipper 46. In the preferred embodiment, the backing material 10 and storage pockets 12 are a synthetic woven fabric such as Dacron, polyester, acrylon, or natural fibers. Within the storage pockets 12 are a plurality of restraint straps 51 comprised of an elongated elastic material fixedly attached at each end to the interior of the storage pocket.

Figure 4:
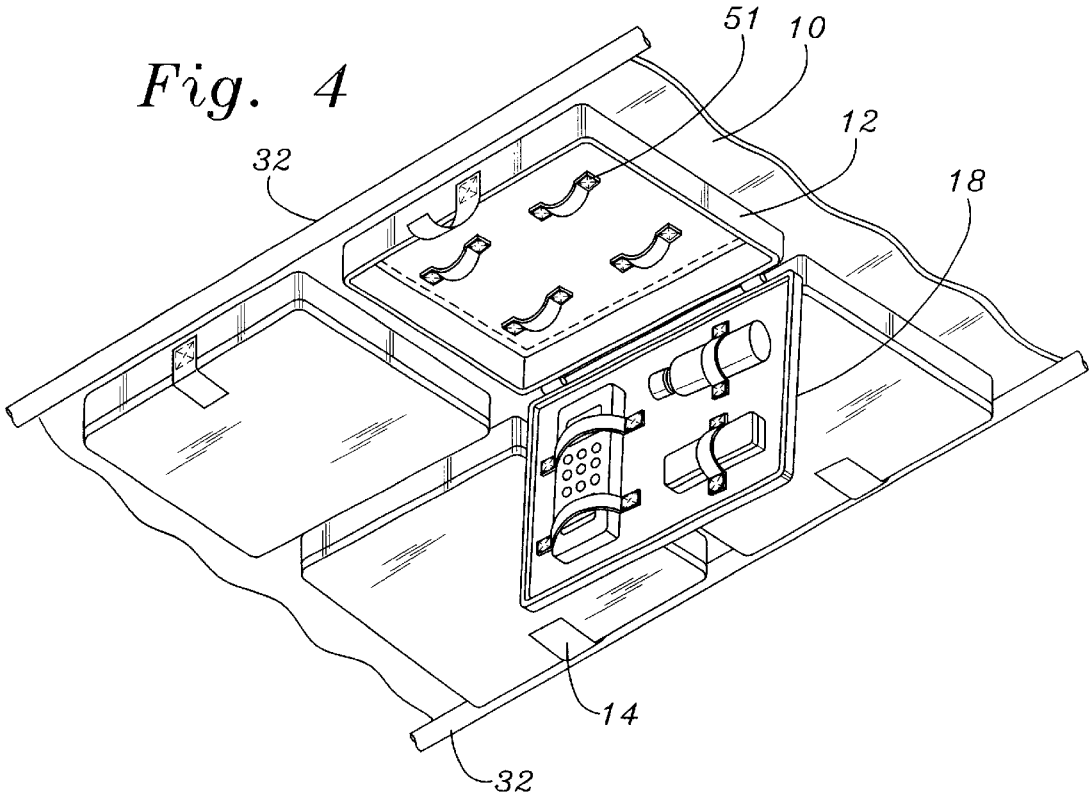
FIG. 4 shows a portion of the storage pockets, an open storage pocket lid, and restraint straps holding personal objects therein.
Figure 5:
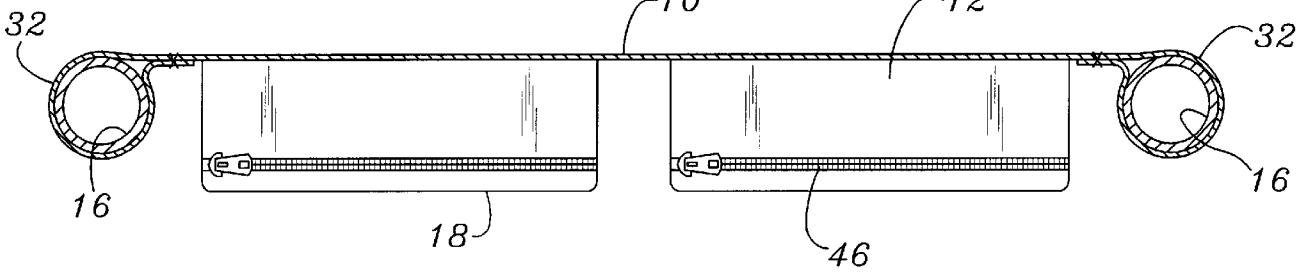
FIG. 5 shows a cross-sectional view of the telescoping poles, backing material, storage pockets, and edge channel.
Figure 6:
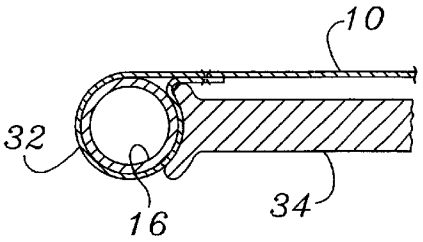
FIG. 6 shows a cross-sectional view of the telescoping pole, backing material, edge channel, and the flared end of the spreader bar.

Along the bottom left and right side of the backing material 10 are an edge channel 32 (FIG. 4). Rolling the longitudinal edge of the backing material 10 into a cylindrical shape and sewing the edge to the underside of the backing material 10 forms the edge channel 32. Each edge channel 32 receives and houses a telescoping pole 16 (FIG. 2) consisting of a female bow end and a male stern end. The preferred embodiment consists of a circular cross-section telescoping pole constructed of rigid, lightweight, non-corrosive material such as aluminum, plastic or fiberglass. The male stern end adjustably slides within the female bow end. The telescoping pole 16 length is fixed by means of a locking mechanism. The preferred embodiment of the locking mechanism is a double eccentric lock as disclosed in U.S. Pat. No. 3,942,896, issued to Lester. Alternatively, a cam lock as disclosed in U.S. Pat. No. 3,596,946 issued to Burton, may be substituted. At the bow end of each telescoping pole 16 is a V-shaped bend 50, which generally conforms to the contour of a bimini shade cover.

Figure 2:
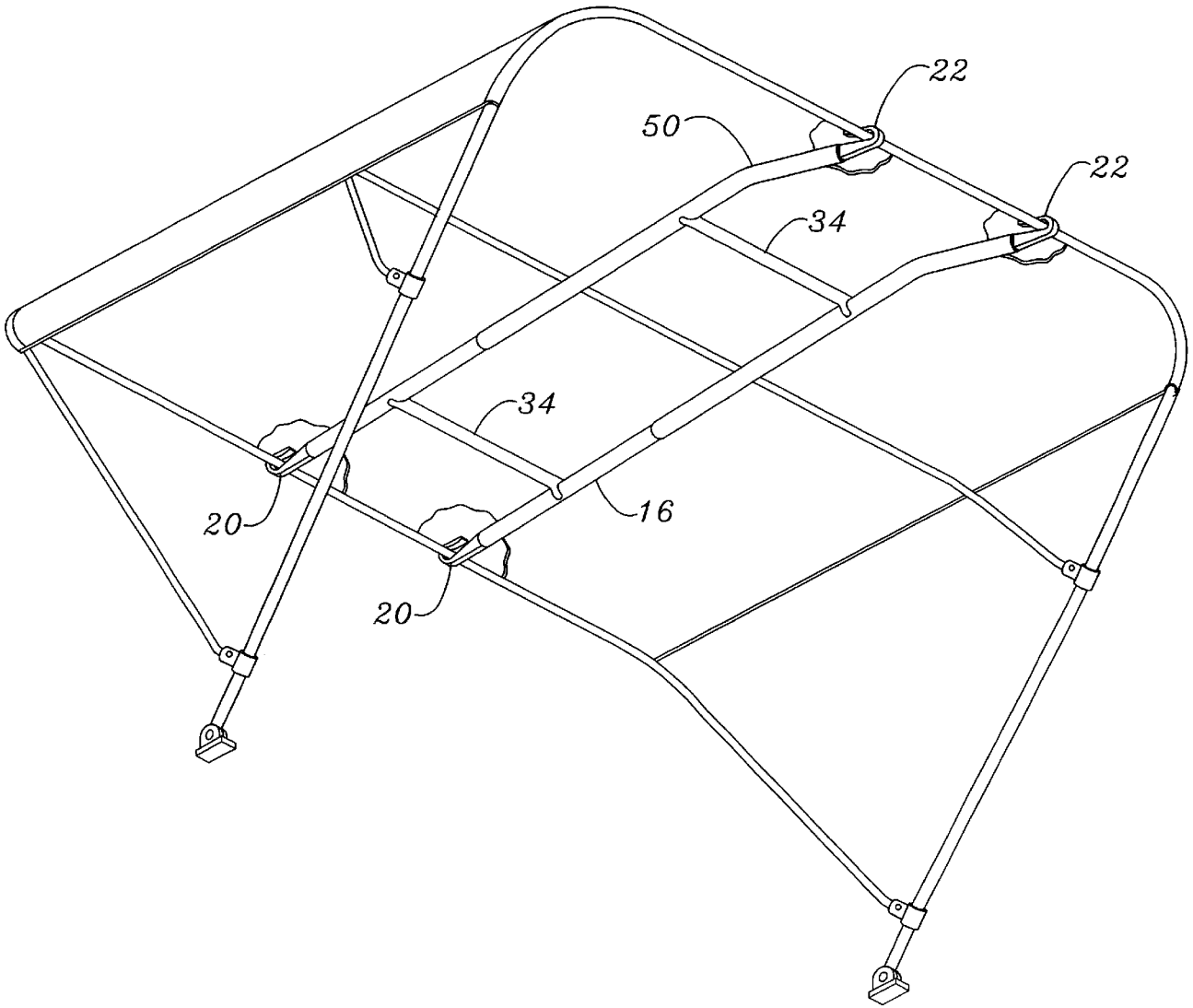
FIG. 2 shows the telescoping poles, bow and stern J-shaped hooks, and spreader bars installed on a bimini top.
Figure 3:
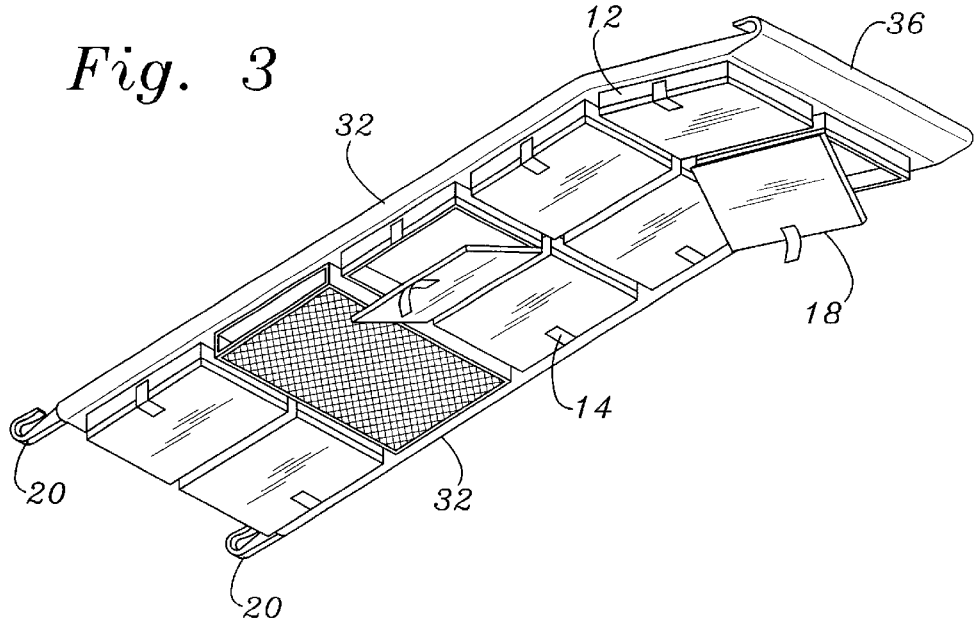
FIG. 3 shows the overhead storage system without reference to a bimini top.

Removably mounted perpendicular to the telescoping poles 16 and below the backing material 10, are several spreader bars 34 (FIG. 2). Each spreader bar 34 consists of a narrow elongated body with a concave flare (FIG. 6) at each end. The spreader bar 34 is slightly longer than the distance between the telescoping poles 16. The radius of the concave flare approximates the diameter of the telescoping pole 16.

Figure 10:
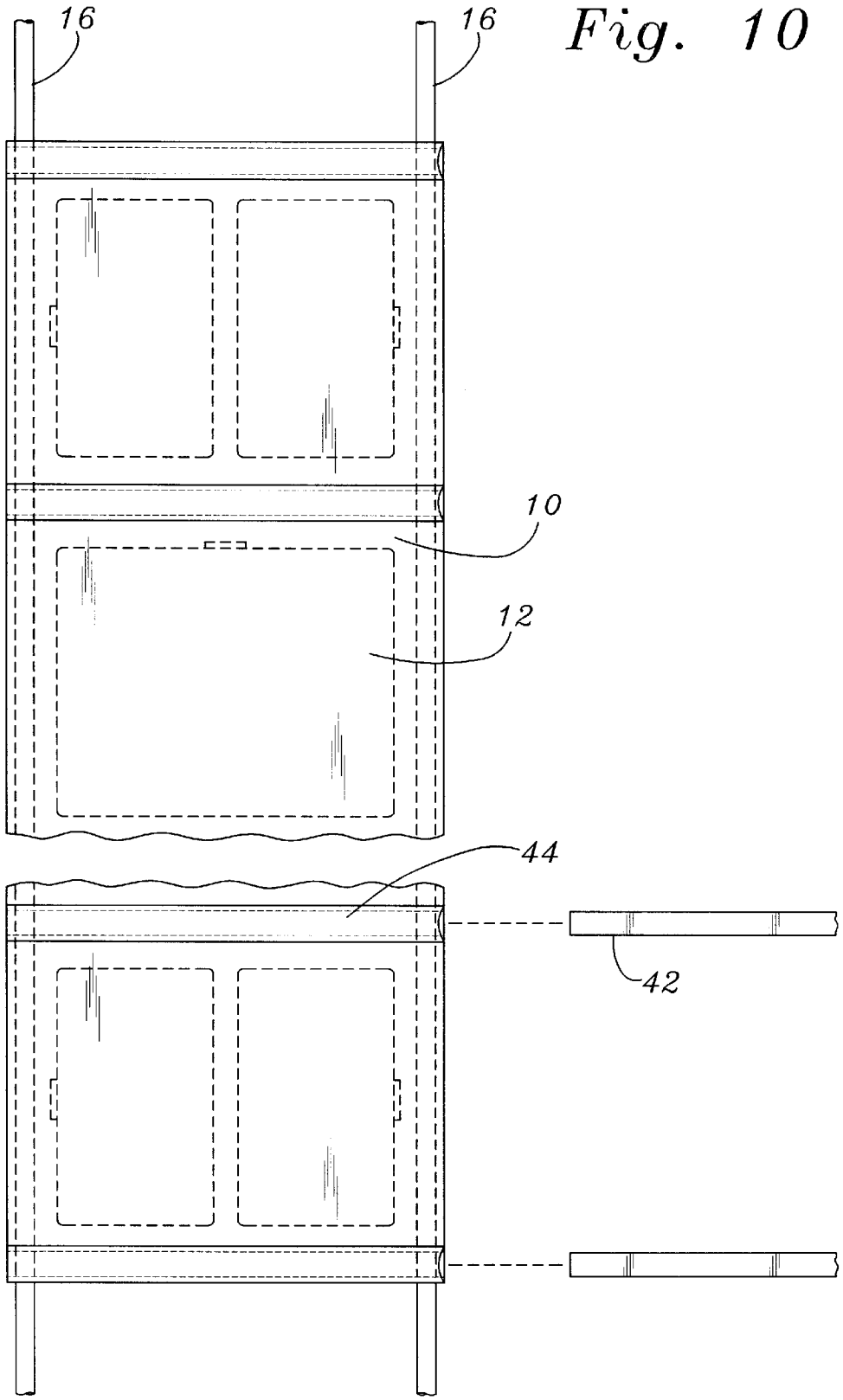
FIG. 10 shows the top of the backing material, batten sleeves, and support battens.

On the top side of the backing material 10 are a series of support battens 42 and batten sleeves 44 (FIG. 10). Each batten sleeve 44 is constructed or a narrow rectangular piece of fabric oriented perpendicular to the left and right edge of the backing material 10. The batten sleeves 44 are sewn on three sides to the top-side of the backing material 10. The open end of the batten sleeve 44 receives the support batten 42. The support batten 44 is flat elongated support element of sufficient length, when inserted in the batten sleeve 44, that each end rests upon a telescoping pole 16. The spreader bar 34 and the support batten 42 are constructed of rigid, lightweight, non-corrosive material such as aluminum, fiberglass, or plastic.

Figure 8:
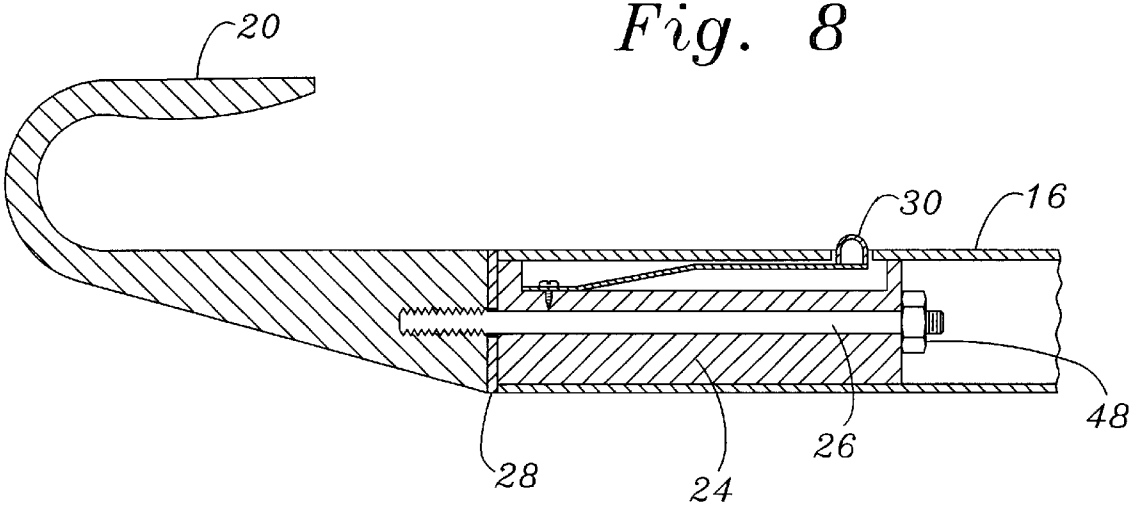
FIG. 8 shows a sectional view of the stern hook assembly.
Figure 9:
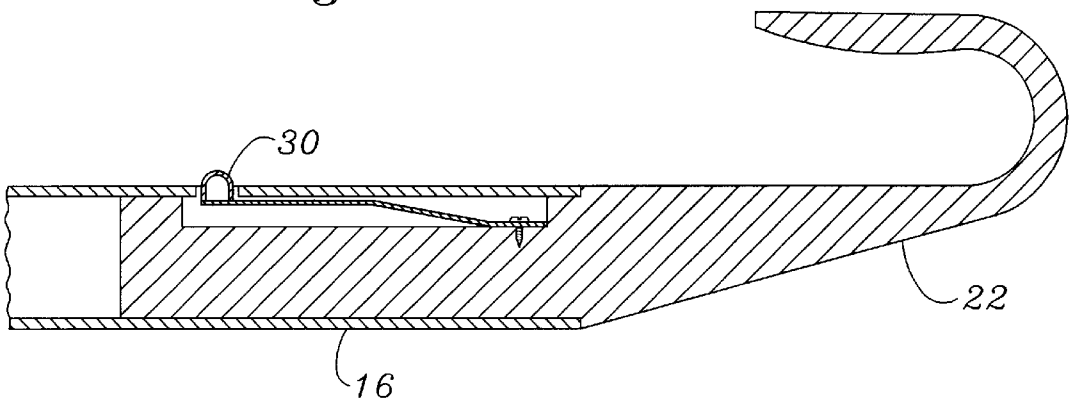
FIG. 9 shows a sectional view of the bow hook, female bow end of the telescoping pole, and spring steel button.

The backing material 10, storage pockets 12, and telescoping pole 16 assembly is removably attached to the front end of the bimini shade cover frame by means of a bow hook 22 and to the rear of a bimini frame by means of a stern hook assembly (FIG. 8). The bow hook 22 consists of an integral J-shaped hook and an elongated cylindrical mounting base of a diameter slightly less than the inside diameter of the female portion of the telescoping pole 16. A longitudinal groove in the top of the mounting base houses a spring steel button 30 that aligns with a hole in the telescoping pole 16 and locks the mounting base into place. The stem hook assembly consists of a J-shaped stern hook 20, a swivel mounting base 24, a spring steel button 30, a threaded rod 26, and a nylon washer 28. One end of the threaded rod 26 is embedded in the J-shaped stern hook 20. The other end of the threaded rod 26 receives the nylon washer 28 and swivel-mounting base 24. A nut and washer 48 secure these elements. The swivel mounting base 24 of the stern hook assembly fits into the stern end of the male portion of the telescoping pole 16 and locks into place by means of the spring steel button 30.

An airfoil 36 (FIG. 7) spans between the bow hooks 22. The airfoil consists of a rectangular piece of fabric with an airfoil sleeve 40 sewn into its left and right side and a cuff 38 at its top. The airfoil sleeve 40 approximates the size and shape of the bow hooks 22. The bow hooks 22 are housed within the airfoil sleeve 40 and are stopped by the cuff 38. The rear of the airfoil 36 is secured to the backing material 10 by hook and loop fasteners 14.

ADDITIONAL EMBODIMENTS

Figure 11:
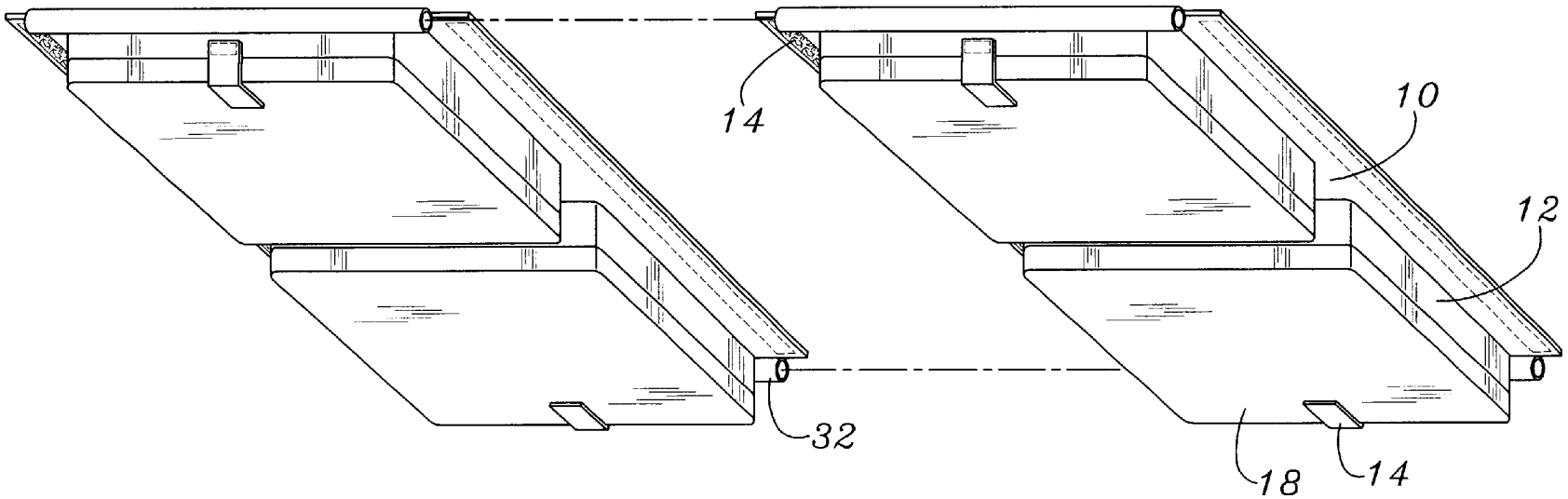
FIG. 11 shows the modular storage pockets.

An additional embodiment is shown in FIG. 11. In this case the backing material 10 and storage pockets 12 are constructed of small modular units. The number of modular units will vary depending on bimini top length and user preference. An edge channel 32 on the left and right side of the backing material 10 holds the modular unit on the telescoping poles 16. A hook and loop fastener 14 connects the modular units to one another. A combination of spreader bars 34 and battens 42, as described in previous paragraphs, keeps the backing material 10 taut between the telescoping poles l6.

OPERATION

Figure 7:
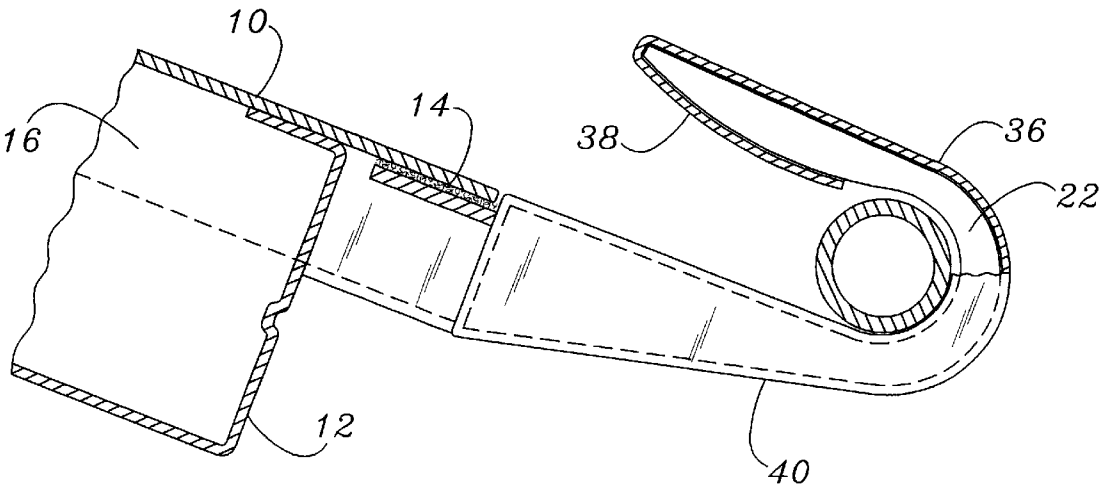
FIG. 7 shows a partial sectional view of the bow hook and airfoil.

To use the overhead storage system of the present invention, the telescoping poles 16 are inserted into the edge channels 32. Each edge channel 32 receives and houses a telescoping pole 16 (FIG. 2). The telescoping poles 16 provide support and structure to the backing material 10 and storage pockets 12. The male stern end of the telescoping pole 16 adjustably slides within the female portion allowing the length of the telescoping pole to be adjusted to fit bimini shade cover frames of varying sizes. The cylindrical base of the bow hooks 22 is inserted into the bow end of the telescoping poles 16 and the stern swivel hook assembly (FIG. 8) is connected to the stern end of the telescoping poles 16. The spring steel button 30 holds the hooks in place on the telescoping poles 16. The airfoil 36 is slipped over the bow hook 22 and secured to the backing material 10 (FIG. 7).

The J-shaped portion of the bow hooks 22 is then positioned at the front of the bimini frame and pushed rearward into place. The male end of each telescoping pole 16 is then slid out to align the J-shaped stern hooks 20 with the rear of the bimini frame. The J-shaped stern hooks 20 are snapped into position on the rear bimini frame and the telescoping poles 16 are twisted to lock into place. The swivel configuration of the stem hook assembly (FIG. 8) allows twisting of the telescoping pole independently of the J-shaped stern hook 20.

Thereafter, the spreader bars 34 and support battens 42 are installed. The spreader bars 34 fit in the transverse oriented space between adjacent storage pockets 12. In the preferred embodiment several spreader bars 34 (FIG. 2) are wedged perpendicular between the left and right telescoping poles 16 thereby holding the telescoping poles apart. The spreader bars 34 are of sufficient length that the backing fabric is stretched taut. The concave flare (FIG. 6) at each end of the spreader bar 34 snaps into position around the telescoping poles 16 and prevents the spreader bar 34 from falling out of position. The support battens 42 are next inserted into the batten sleeves 44. The battens 42 are of sufficient length that each end rests upon a telescoping pole thereby supporting the backing material 10. The overhead storage system is now ready for storage of personal items. Personal items placed in the overhead storage system are retained in the storage pockets 12 by restraint straps 51.

To use the modular storage pockets (FIG. 11), a number of the modular storage units are slid onto the telescoping poles 16. The number of modular units will vary depending on the length of a bimini top and preference of the user. The modular storage pockets are butted end-to-end and secured to each other along their transverse edge with hook and loop fasteners 14. Additionally, the modular storage pockets may also be used in combination with the unitized storage pockets.

To remove the overhead storage system, the male stern end of telescoping poles 16 are unlocked and the J-shaped stern hook 20 and bow hook 22 are removed from the bimini frame. The storage system can be folded along its longitudinal centerline with the telescoping poles 16 still installed and stored under the bow or gunnels of the boat. The telescoping poles 16 may also be removed from the edge channels 32 by removing either the bow hooks 22 or the stern hook assemblies. Once the telescoping poles 16 are removed, the backing fabric 10 and storage pockets 12 can be folded into a small package for convenient storage.

CONCLUSION, RAMIFICATIONS, AND SCOPE

Accordingly, the reader will see that the overhead storage system attachable to a bimini top of the present invention can be easily installed, requires no special tools or fittings for installation, and is easily removed. In addition, the invention provides storage conveniently located in the cockpit area of the boat, within easy reach of the boat driver and passengers, and has enough storage pockets to allow each passenger to organize their personal items separately from others.

Although the description above contains many specifications, these should not be construed as limiting the scope of the invention but as merely providing illustrations of some of the presently preferred embodiments of this invention. For example, the backing fabric can be stiffened by sewing thin semi-rigid plastic sheets into its surface; the telescoping poles can be made of square tubing; the telescoping poles can be replaced by elastic cord; a multitude of storage pocket configurations, sizes, and shapes can be incorporated; the stern swivel hook can be made fixed if the telescoping pole locking mechanism is a cam-lock or spring button lock; the storage system can be scaled to fit the smaller bimini tops of personal watercraft; the telescoping poles could be fixedly attached to the bimini frame; the storage pockets could be removably mounted to the underside of the backing material with hook and loop fasteners, etc.

Thus the scope of the invention should be determined by the appended claims and their legal equivalents, rather than by the examples given.

I claim:

1. An overhead storage system for holding objects attachable to a bimini top comprising:

a pair of parallel longitudinal support means having a bow end and a stern end;

an attachment means for mounting said bow end of said pair of parallel longitudinal support means and said stern end of said pair of parallel longitudinal support means to said bimini top;

an elongated backing material having a top side, a bottom side, a bow end, a stern end, a right side, and left side, removably mounted between said pair of parallel longitudinal support means;

a multiplicity of storage pockets attached to said bottom side of said backing material.

2. The overhead storage system of claim 1 wherein said longitudinal support, means comprise a pair of cylindrical telescoping poles.

3. The overhead storage system of claim 1 wherein said attachment means for mounting said bow end of said longitudinal support means to said bimini top is a J-shaped hook possessing an integral elongated cylindrical base, said cylindrical base installed within with said bow end of said longitudinal support means.

4. The overhead storage system of claim 1 wherein said attachment means for mounting said stern end of said longitudinal support means to said bimini top is a J-shaped hook, rotatably mounted to said stern end of said longitudinal support means.

5. The overhead storage system of claim 1 wherein said backing material is composed of woven fabric having an edge channel sewn into said right and left side, and said longitudinal support means being housed therein.

6. The overhead storage system of claim 1 wherein said storage pockets have an openable bottom side, four vertical sides, and a top side sewn to said bottom side of said backing material.

7. The overhead storage system of claim 1, wherein said backing material contains a means to stiffen and hold said backing fabric taut between said longitudinal support means.

8. The overhead storage system of claim 7 wherein said means to stiffen and hold said backing material taut between said longitudinal support means is a series of detachable rigid spreader bars oriented perpendicular to said longitudinal support means and below said backing material.

9. The overhead storage system of claim 7, wherein said means to stiffen and hold said backing material taught between said longitudinal support means is a series of rigid battens transversely mounted on said top side of said backing material.

10. The overhead storage system of claim 3, wherein a fabric airfoil is removably mounted between said J-shaped hooks.

11. An overhead storage system for holding objects attachable to a bimini top comprising:

a pair of parallel longitudinal support means having a bow end and a stern end, an attachment means for mounting said bow end of said pair of parallel longitudinal support means and said stern end of said pair of parallel longitudinal support means to said bimini top;

a plurality of modular backing material having a top side, a bottom side, a bow end, a stern end, a right side, and left side removably mounted between said pair of parallel longitudinal support means;

a multiplicity of storage pockets attached to said bottom side of said plurality of modular backing material.

12. The overhead storage system of claim 11 wherein said longitudinal support means comprise a pair of cylindrical telescoping poles.

13. The overhead storage system of claim 11 wherein said attachment means for mounting said bow end of said longitudinal support means to said bimini top is a J-shaped hook and integral elongated cylindrical base, and said cylindrical base installed within said bow end of said longitudinal support means.

14. The overhead storage system of claim 11 wherein said attachment means for mounting said stern end of said longitudinal support means to said bimini top is a J-shaped hook rotatably mounted to said stern end of said longitudinal support means.

15. The overhead storage system of claim 11 wherein said plurality of backing material is composed of woven fabric having an edge channel sewn into said right and left side and said longitudinal support means being housed therein.

16. The overhead storage system of claim 11 wherein said storage pockets have an openable bottom side, four vertical sides, and a top side attached to said bottom side of said plurality of backing material with hook and loop fasteners.

17. The overhead storage system of claim 11, wherein said plurality of backing material contains a means to stiffen and hold said backing material taut between said longitudinal support means.

18. The overhead storage system of claim 17, wherein said means to stiffen and hold said plurality of backing material taut between said longitudinal support means is a series of rigid battens transversely mounted to said top side of said backing material.

19. The overhead storage system of claim 12, wherein a fabric airfoil is removably mounted between said J-shaped hooks.

* * * * *